United States Patent [19]

Chujo et al.

[11] Patent Number: 4,924,837

[45] Date of Patent: May 15, 1990

[54] INTERNAL COMBUSTION ENGINE HAVING ELECTRIC CONTROLLED FUEL INJECTION WITH OXYGEN SENSOR FOR DETECTING INTAKE AIR AMOUNT

[75] Inventors: Yoshiki Chujo, Mishima; Keiji Aoki, Susono; Yoshihiko Hyodo; Toshiyasu Katsuno, both of Susono, all of Japan

[73] Assignee: Toyota Jidosha Kabushiki Kaisha, Aichi, Japan

[21] Appl. No.: 360,243

[22] Filed: Jun. 1, 1989

[30] Foreign Application Priority Data

Jun. 11, 1988 [JP] Japan ..... 63-142789

[51] Int. Cl.[5] ..... F02D 41/22; F02M 51/00

[52] U.S. Cl. ..... 123/494; 123/440; 123/489

[58] Field of Search ..... 123/494, 489, 440; 60/276, 228, 285; 204/424, 425, 426

[56] References Cited

U.S. PATENT DOCUMENTS

| | | | |
|---|---|---|---|
| 4,005,689 | 2/1977 | Barnard | 123/119 A |
| 4,108,122 | 8/1978 | Barnard | 123/119 |
| 4,272,329 | 1/1981 | Hetric et al. | 204/1 T |
| 4,614,175 | 9/1986 | Asayama | 123/571 |
| 4,705,009 | 11/1987 | Asayama | 123/571 |
| 4,741,313 | 5/1988 | Shimomura | 123/494 |
| 4,747,387 | 5/1988 | Takao et al. | 123/494 |
| 4,770,146 | 9/1988 | Shibata et al. | 123/494 |
| 4,800,857 | 1/1989 | Conisawa | 123/489 |
| 4,853,862 | 8/1989 | Shiraishi et al. | 123/440 |
| 4,854,288 | 8/1989 | Uchikawa | 123/489 |
| 4,860,712 | 8/1989 | Nakajima et al. | 123/489 |

*Primary Examiner*—Raymond A. Neill

*Attorney, Agent, or Firm*—Kenyon & Kenyon

[57] ABSTRACT

A fuel injection system for an internal combustion engine wherein an oxygen sensor for detecting a limit electric current is employed for providing a signal indicating an oxygen partial pressure in the gas introduced into the engine. The sensor detects an amount of air newly introduced into the engine. In addition to a map for calculating a basic fuel injection amount from the oxygen partial pressure, a second map is provided for calculating the basic fuel amount from a parameter such as a degree of opening of the throttle valve. A degree of activation of the oxygen sensor is determined by detecting the impedance of the sensor. When it is determined that the oxygen sensor is not activated, the second map is employed in place of the first map to calculate the basic fuel amount based on the degree of opening of the throttle valve.

9 Claims, 8 Drawing Sheets

INTERNAL COMBUSTION ENGINE HAVING ELECTRIC CONTROLLED FUEL INJECTION WITH OXYGEN SENSOR FOR DETECTING INTAKE AIR AMOUNT

BACKGROUND OF THE INVENTION

1. Field of the Invention

The present invention relates to an apparatus for controlling a fuel injection for an internal combustion engine, and more particularly to an apparatus having a sensor including a heater and arranged in an intake system downstream of a throttle valve, which sensor responds to a partial pressure of oxygen in air introduced into the engine, for detecting an amount of newly introduced air for controlling an engine control characteristic such as a fuel injection amount or an ignition timing.

2. Description of the Related Art

Known in the prior art is a device having a heater installed type oxygen sensor including a heater and responsive to an oxygen partial pressure of an intake air for detecting an amount of air newly introduced into an internal combustion engine for controlling an engine control parameter such as a fuel injection amount or an ignition timing. In this type of device, the oxygen sensor comprises a body formed of a solid electrolyte, such as zirconia, platinum electrodes arranged on both sides of the body, and a diffusing layer of a porous ceramic material on one side of the body and covering the platinum electrode on that side. Here, $O_2$ particles are passed through the diffusing layer by a pumping operation at a controlled rate so that a limited electric current is obtained. The value of the limited electric current obtained when a predetermined constant voltage is applied across the electrodes on the electrolyte body is proportional to the value of the oxygen partial pressure in the total pressure of the intake air, and as a result, an amount of air newly introduced into the engine, which is proportional to the oxygen partial pressure, can be detected. An engine control of an engine parameter such as a fuel injection amount or an ignition timing is carried out in accordance with the amount of newly introduced air detected by the oxygen partial pressure. This type of control system including the oxygen partial pressure sensor for detecting the amount of newly introduced air is advantageous in that the arrangement of the sensor in the intake system incurs only a very limited increase of an intake resistance, and in that a precise control of the air-fuel ratio can be made since the amount of newly introduced air is itself directly detected. It should be noted that, in most conventional systems, the amount of air is not directly detected and the intake air pressure is indirectly detected as a measure of the amount of newly introduced air.

To obtain a high degree of precision in the detection of the oxygen partial pressure by this type of sensor, the temperature of the sensor must be controlled to a predetermined value, and accordingly, the sensor is provided with an electric heater device and a device for controlling the electric current or voltage in the heater. Nevertheless, when the engine is started, the temperature of the sensor is not rapidly increased even if the heater is operated, and thus a partial pressure of the oxygen can not be correctly detected. As a result, a control of the fuel injection amount or ignition timing based on an incorrect value of the oxygen partial pressure is carried out, and thus a precise control of the air-fuel ratio or ignition timing to a target value can not be made.

SUMMARY OF THE INVENTION

An object of the present invention is to provide an engine control apparatus capable of obtaining a desired control of the engine regardless of the degree of activity of an oxygen sensor.

Therefore, according to the present invention, an internal combustion engine is provided which comprises:

- an engine body;
- an intake system for an introduction of air into the engine body, said intake system having a throttle valve for controlling an amount of air introduced into the engine body;
- control means for controlling an operating characteristic related to the amount of air introduced into the engine;
- an exhaust system for removing resultant exhaust gases from the engine body;
- oxygen sensor means, arranged in the intake system and responsive to a partial pressure of oxygen in the intake system, for detecting an amount of air newly introduced into the engine;
- heater means arranged in the oxygen sensor for activating the oxygen sensor;
- heater control means for controlling a temperature of the oxygen sensor to a predetermined value;
- determining means for determining whether or not the sensor has been activated;
- first calculating means, responsive to the oxygen partial pressure detected by the oxygen sensor means, for calculating a value of said engine operating characteristic matched to the detected amount of air newly introduced into the engine when it is determined by the determining means that the sensor has been activated;
- second detecting means for detecting, without using the detected oxygen partial pressure, a parameter indicating an amount of air newly introduced into the engine when it is determined by the determining means that the sensor has not been activated and;
- second calculating means, responsive to the detected parameter, for calculating a value of said engine operating characteristic matched to the detected amount of air newly introduced into the engine.

DESCRIPTION OF THE PREFERRED EMBODIMENTS

Figure 1:
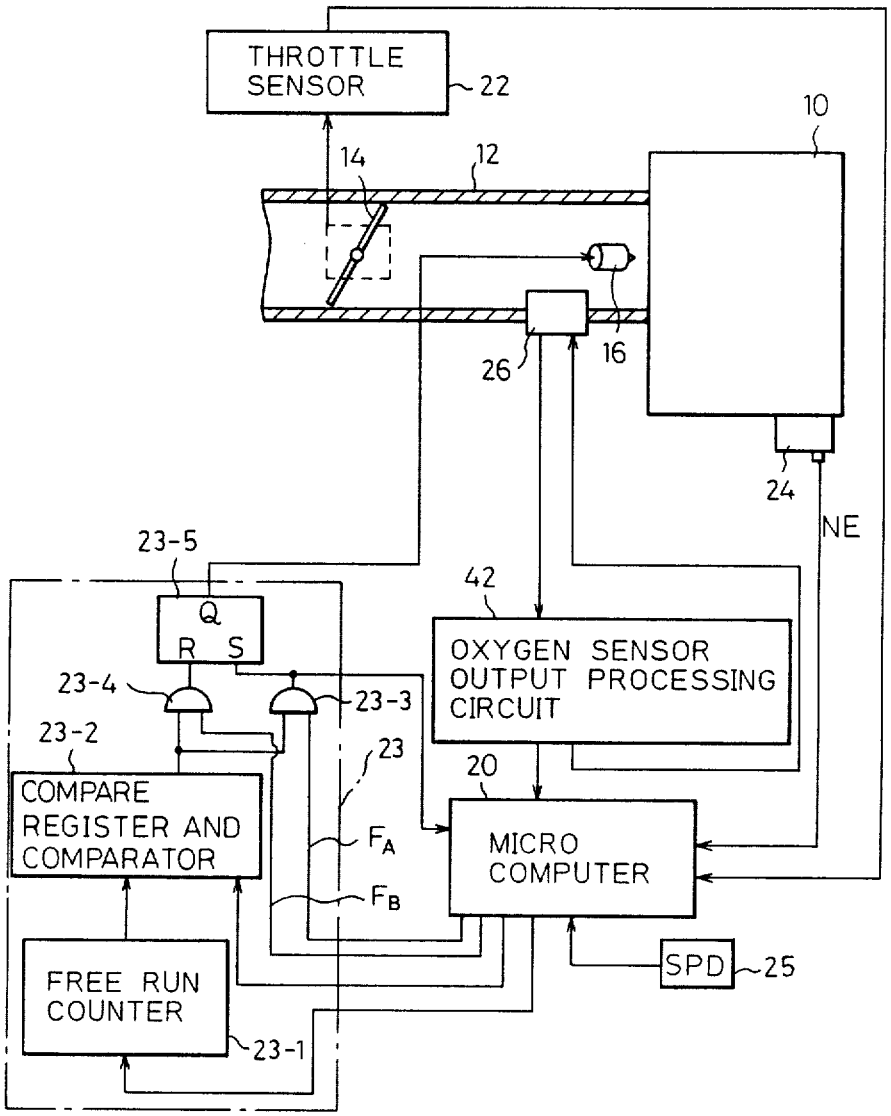
FIG. 1 is a general schematic view of an internal combustion engine according to the present invention.

In FIG. 1, which is a general schematic view of an internal combustion engine for a vehicle, 10 denotes an engine body, 12 an intake pipe, 14 a throttle valve, and 16 a fuel injector. A microcomputer system 20, in response to operating condition signals received from various sensors, calculates a fuel injection amount and issues a fuel injection signal to the injector 16 so that the calculated amount of fuel is injected. Among these sensors, a throttle sensor 22 detects the degree of opening of the throttle valve 14, which degree corresponds to an engine load, and an engine speed sensor 24 is a transducer for generating pulse signals corresponding to a rotational speed of a crankshaft of the engine. The engine speed can be determined from a time between two successive pulse signals. Numeral 25 denotes a sensor for detecting a speed of the vehicle. Connected to the control circuit 20 is an injection control unit 23, which comprises a free run counter 23-1, a compare register 23-2, gates 23-3 and 23-4, and a flip-flop circuit 23-5. The injection control unit 23 controls the fuel injection operation by the injector 16. The compare register 23-2 of, for example, 8 bits, has a first input connected to the free run counter 23-1 and a second input connected to a port of the microcomputer 20 for setting a time. The first gate 23-3 has a first input connected to the output of the compare register 23-2, a second input connected to a port of the microcomputer 20, representing a value of an interruption permission flag $F_A$, and an output connected to the set terminal of the flip-flop 23-5 and interruption port of the microcomputer 20. The second gate 23-4 has a first input connected to the output of the compare register 23-2, a second input connected to a port of the microcomputer 20, representing a value of a fuel injection stopping flag $F_B$, and an output connected to the reset terminal of the flip-flop 23-5.

Figure 2:
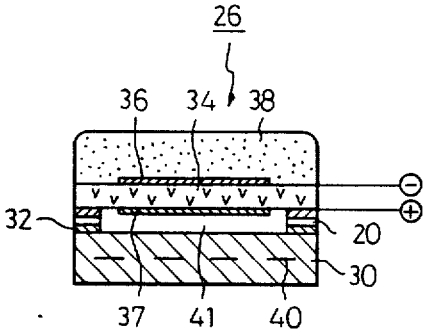
FIG. 2 is an enlarged cross sectional view of the oxygen sensor in FIG. 1.

Numeral 26 denotes an oxygen sensor for detecting an amount of newly introduced air from a partial pressure of oxygen in the gas introduced into the engine. As shown in FIG. 2, this oxygen sensor 26 is provided with a base 30, a spacer 32 on the base 30, a body 34, formed of a solid electrolyte such as zirconia, on the spacer 32, electrodes 36 and 37 formed on opposite sides of the electrolyte body 34, a block 38 of a porous ceramic material serving as a gas diffusion layer and arranged on the side of the electrolyte body 34 to enclose the first electrode 36, and a heater 40 embedded in the base 30. The gas diffusion layer 38 is arranged to be in contact with the exhaust gas in the intake pipe 12. A chamber 41 is formed between the body 34 and the base 30, and the spacer 32 has holes 20 formed therein for venting the space 41 to the atmosphere. When a voltage is applied to the electrodes 36 and 37, oxygen ions flow between the electrodes 36 and 37 at a rate determined by the speed of transmission of the oxygen particles through the diffusion layer 38.

Figure 3:
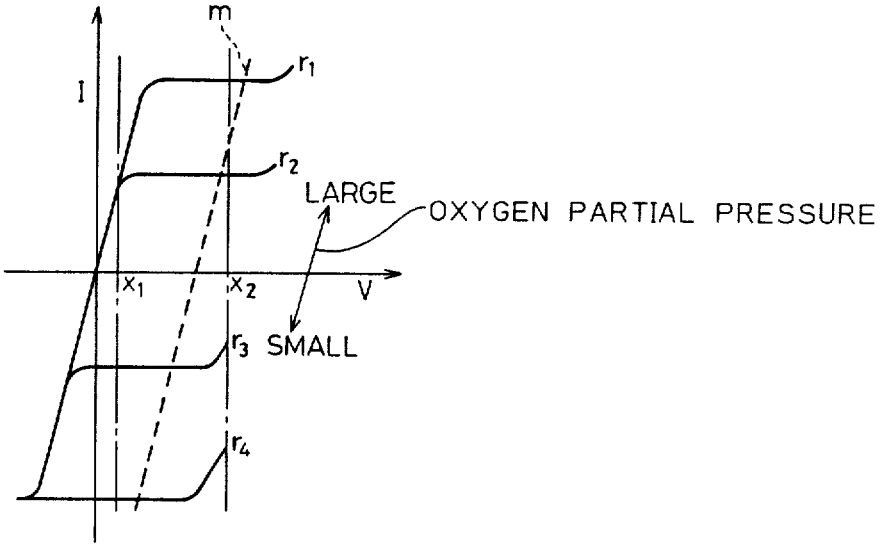
FIG. 3 shows the relationships between a voltage as applied and an electric current generated in the oxygen sensor in FIG. 1.

FIG. 3 shows the relationships between a voltage applied across the electrodes 36 and 37 and an electric current in the electrolyte body 34 when the value of the oxygen partial pressure is changed. In FIG. 3 four curves $r_1$ to $r_4$ are shown, and the oxygen partial pressure is decreased as the suffix number is increased. As will be seen from these curves, the value of the electric current becomes higher as the oxygen partial pressure is increased. Each of these curves is composed of an inclined straight portion at which a linear relationship exists between the voltage and the electric current, and a flat or saturated portion occurring after the value of the electric current is saturated. The values of the electric current at the saturated portions of the curves, referred to as the limit current, are proportional to the values of the oxygen pressure. Accordingly, the oxygen partial pressure can be determined by measuring the value of the current when the voltage providing the saturated zones is applied to the electrodes 36 and 37. It should be noted that the positions of the saturated portions of the curves are shifted toward the high voltage side as the oxygen partial pressure is further increased as a result of a voltage drop caused by the resistance component in the sensor. Namely, if a constant voltage is applied between the electrodes 36 and 37, the voltage at all of the saturated zones can not be detected. For example, when a voltage designated $X_1$ is applied, the limiting current on the curves $r_3$ and $r_4$ at a low oxygen partial pressure zone can be detected, but the limiting current on the curves $r_1$ and $r_2$ at high oxygen partial pressure zones can not be detected. Contrary to this, when a voltage designated $X_2$ is applied, the limiting current on the curves $r_1$ and $r_2$ can be detected but the limiting current on the curves $r_3$ and $r_4$ can not be detected. To enable a detection of the pumping current at the saturated zones, a means is provided for applying a voltage across the electrodes 36 and 37 which voltage is increased as the oxygen partial pressure is increased, as shown by a dotted line m in FIG. 3 and described later. In FIG. 2 the electrodes 36 and 37 are connected to the microcomputer unit 20 via a processing circuit 42, to enable a compensation of the linearity and temperature coefficient in the output of the oxygen sensor 26.

Figure 4:
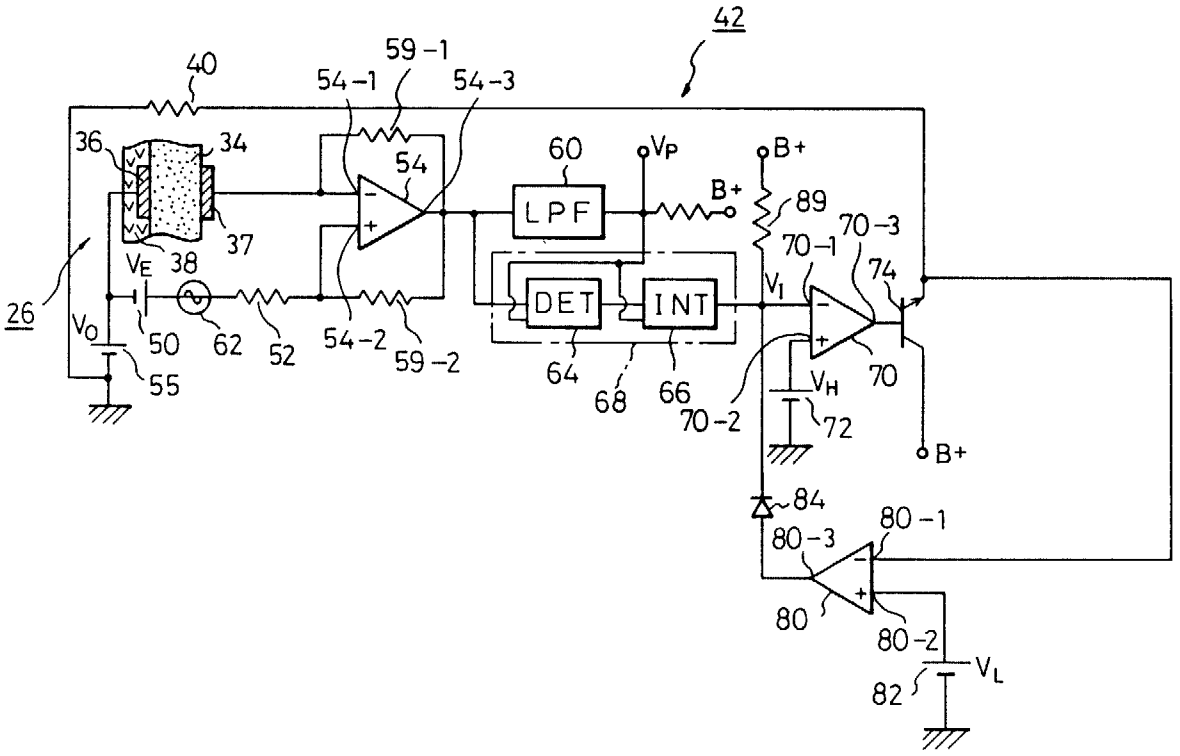
FIG. 4 is an electrical circuit for controlling the oxygen sensor.

The processing circuit 42 as shown in FIG. 4, is provided with a first operation circuit 54 as a comparator having a first inverted input 54-1, a second non-inverted input 54-2, and an output 54-3. The sensor electrodes 37 and 36 are located on the side of the comparator 54 and a voltage source 50 for producing a reference voltage $V_E$ is located on the side of the second input 54-2 of the comparator 54. The comparator 54 operates, basically, to apply a voltage across the electrodes 37 and 38 in the saturated area thereof.

The second electrode 37 of the oxygen sensor 26 is connected to the first input 54-1 of the comparator 54 and the first electrode 36 is connected to the minus side of the reference voltage source 50. The plus side of the reference voltage source 54 is connected to the second input 54-2 of the comparator 54 via a pulsator 62 and a resistor 52. The first electrode 36 is connected to ground via an electric source 55 of a predetermined voltage $V_0$ for an upward shift of the basic characteristic curves of the oxygen sensor 26 in FIG. 3, so that a voltage at the plus side always appears at the output side of the comparator 54.

As is well known, the operation circuit 54 maintains the voltage levels of the first and second inputs 54-1 and 54-2. In other words, a voltage in the saturated zone in the characteristic of the oxygen sensor, corresponding to the voltage $V_E$, is applied across the electrodes 26 and 37, which enables detection of an oxygen partial pressure from the pumping current. A first feedback resistor 59-1 is arranged between the output 54-3 and the first inverted input 54-1 of the operation amplifier 54. This first feedback resistor 59-1 obtains an electric current at the output 54-3 proportional to the pumping current across the electrodes 36 and 37 and representing the oxygen partial pressure in the gas introduced into the engine combustion chamber. A second feedback resistor 59-2 is arranged between the output 54-3 and the second non-inverted input 54-2 of the operation amplifier 54. This second feedback resistor 59-2 together with a resistor 52 composes a means for controlling the voltage applied between the electrodes 36 and 37 so that the pumping current at the saturated area is obtained. The resistor 52 has a first end connected to the non-inverted output 54-2 of the comparator 54 and a second end connected in series with respect to the reference voltage source 50 via the device 62, for generating a periodically changed electric voltage added to the fixed voltage $V_E$ by the source 50 and for a detection of the impedance of the sensor 26. The detection of the sensor impedance is used for compensation of a temperature change in the output of the sensor, as will be described later. The second feedback resistor 59-2 is also connected to the non-inverted input 54-2 of the comparator 54. Since an electric current corresponding to the pumping current in the oxygen sensor is obtained at the output 54-3, as already explained, an electric current corresponding to the pumping current is also obtained in the resistor 52 via the second feed back resistor 59-2, so that a voltage drop corresponding to the pumping current in the oxygen sensor 26 is obtained at the resistor 52 arranged in series with respect to the reference voltage source 50. This means that the voltage level at the non-inverted input 54-2 of the comparator is increased in accordance with the increase in the pumping current, as shown by the arrow in FIG. 3, enabling the pumping current at the saturating zone to be measured regardless of the values of the oxygen partial pressure. It should be noted that the voltage level at the input 54-2, i.e., the voltage applied across the electrodes 36 and 37, is expressed by the following equation.

$$V_E = +Ipxr$$

The value of the resistor is such that the desired curve is obtained to enable the detection of the limiting current at all of the saturated zones, to ensure that the oxygen partial pressure is precisely detected. As will be understood from the above description, the fixed voltage source 50 plus the resistor element 52 are considered to be an equivalent circuit of the oxygen sensor 26.

The control circuit 42 further includes a low-pass filter 60 for detection of the alternating current component caused by the voltage generator 62. The provision of the low-pass filter 60 makes it possible to obtain only a direct current component signal $PO_2$ proportional to the oxygen partial pressure in the gas introduced into the engine combustion chamber.

The control circuit 42 is further provided with a circuit 68 for detecting the impedance of the sensor 26. This circuit 68 is composed of the alternating current generator 62 arranged between the fixed voltage source 62 and the resistor 52, and a detector circuit 64 and integrator circuit 66. The detector circuit 64 has a first input connected to the output 54-3 of the operating amplifier 54 and a second input connected to the output of the low-pass filter 60, and the integrator circuit 66 has a first input connected to the output of the low-pass filter 60 and a second input connected to the output of the detector circuit 64. The detector circuit 64 detects the alternating current component in the sensor signal, which corresponds to the impedance of the sensor, and the integrator 66 integrates the detected signal so that a time averaged alternating current component can be obtained.

The control circuit 42 is further provided with a second operating amplifier 70 and a transistor 74 for controlling the electric current applied to the heater 40 of the oxygen sensor 26 to obtain a constant value of the impedance of the sensor 26. The second operating amplifier 70 has a first input 70-1 connected to the output of the integrating circuit 66, a second 70-2 connected to a reference voltage source 72 attaining a voltage of $V_H$, and an output connected to the transistor 74 at the base thereof. The heater 40 is arranged between the emitter of the transistor 74 and the ground. The collector of the transistor 74 is connected to the power source (B+).

The principle of the temperature compensation of oxygen sensor 26 is that the temperature of the sensor 26 corresponds to an impedance of the sensor 26, and therefore, when a predetermined constant value of the impedance of the sensor 26 is maintained, a constant value of the temperature of the sensor 26 is obtained. In other words, when a constant value of the impedance of the sensor 26 is maintained, it is considered that the temperature of the sensor 26 is also maintained at a constant value, and thus a precise value of the oxygen partial pressure as measured can be obtained. In FIG. 4, the alternating current voltage generator 62, the device for detecting the impedance 68, the operating amplifier 70, and the transistor 74 compose a device for controlling the electric current in the heater 40, to obtain a constant temperature of the sensor 26. The signal from the sensor 26 comprises the direct current corresponding to the oxygen partial pressure of the gas introduced into the engine, and the alternating current component obtained by the alternating current generator 62 and added to the direct current component. The low-pass filter 60 allows only the direct current component from the combined signal to be passed therethrough, and this is used in the microcomputer system 20 to obtain an engine control such as a fuel injection, as described later. The detector circuit 64 allows only the alternate current component from the combined signal to be passed, by subtracting the direct current component obtained by the low-pass filter 60 from the combined signal. Namely, a signal corresponding to the frequency of the alternate current is obtained. Since the impedance of the sensor 26 is proportional to the frequency of the signal generated by the sensor, the voltage level from the detector circuit represents the impedance of the oxygen sensor 26. At the integrator circuit 66, the signal from the detector circuit 64 is time averaged, and at the comparator circuit 70, the voltage level from the integrator circuit 66 representing the impedance of the sensor 26 is compared with a reference voltage $V_H$ corresponding to the predetermined impedance of the sensor 26 obtained at a predetermined temperature of the sensor 26, such as 630 degrees centigrade. The comparator 70 makes the transistor 74 ON when the actual voltage is lower than the reference voltage $V_H$. The transistor 70 is made ON to energize the heater 40 and the temperature of the heater 40 is increased to decrease the impedance. The comparator 70 makes the transistor OFF when the actual voltage is higher than the reference voltage $V_H$. The transistor 70 is made OFF to de-energize the heater 40 and the temperature of the heater 40 is decreased to increase the impedance. As a result of a repetition of this operation, the impedance of the heater 40 is controlled to a predetermined value, which corresponds to the reference voltage $V_H$ representing a predetermined temperature of the oxygen sensor 26, such as 700 degrees centigrade.

Figure 6:
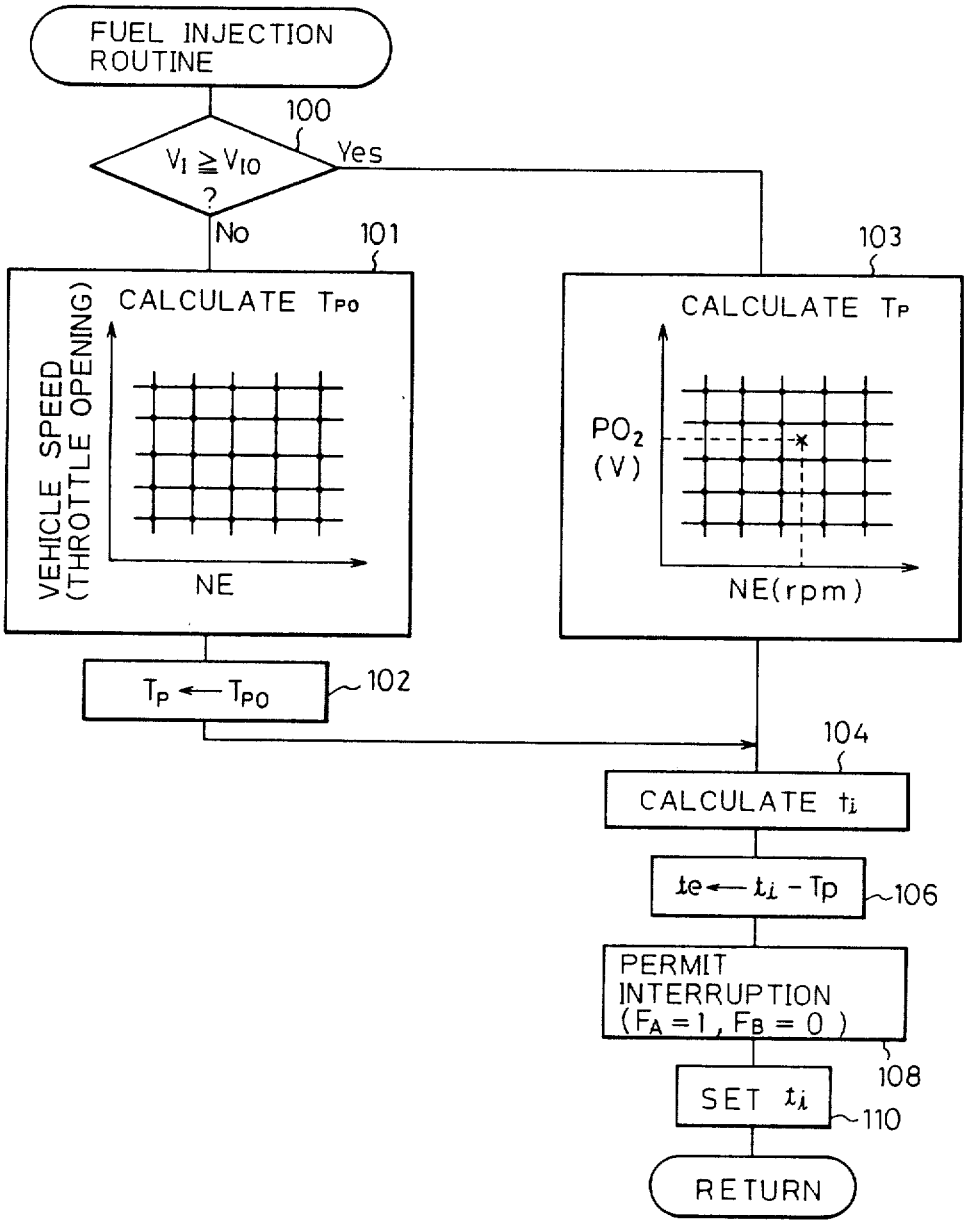
FIG. 6 and 7 are flowcharts of the fuel injection control by the control circuit in FIG. 1.

The control circuit 42 further includes a third operating amplifier 80 for maintaining the electric current in the heater 40 at a maximum current, to prevent damage thereto. The third comparator circuit 80 is provided with a first inverted input 80-1 connected to the emitter of the transistor 74, which is connected to one end of the heater 40, a second non-inverted input 80-2 connected to a fixed voltage source of a predetermined voltage value $V_L$, the value of which is determined in accordance with the upper permissible electric current in the heater 40, and an output 80-3 connected, via a diode 84, to the inverted input 70-1 of the comparator 70. Before the value of the electric current the heater has reached the maximum value, the level at the input 80-1 is lower than the level $V_L$ at the input 80-2, so that comparator 80 issues a high level signal. When the engine is started from a cold condition, the level of the output $V_I$ from the integrator circuit 66, which corresponds to the value of the impedance of the sensor 26, is small as shown by FIG. 6 (*b*). As a result, $V_I<V_H$, and thus the comparator 70 issues a "1" output to make transistor 74 ON, and thus energize the heater 40 until the value of the electric current in the heater 40 has reached the maximum value $I_H$. When the value of the electric current in the heater 40 has reached the maximum value, which is the reference voltage $V_L$, the comparator circuit 80 outputs a low level signal. This causes the diode 84 to be made OFF, so that the level of the input 70-1 of the comparator connected to B+ via a resistor 89 reaches a high level, and thus the comparator circuit 70 outputs a low level signal even though a condition still exists wherein the level $V_I$ at the first input 70-1 is smaller that the level $V_H$ at the second input 70-2, i.e., $V_I<V_H$. Furthermore the output signal of the integrator circuit 66 VI is load to the micro computer 20 and used to determine whether or not the sensor has been activated as mentioned later.

Figures 5A, 5B, 5C:
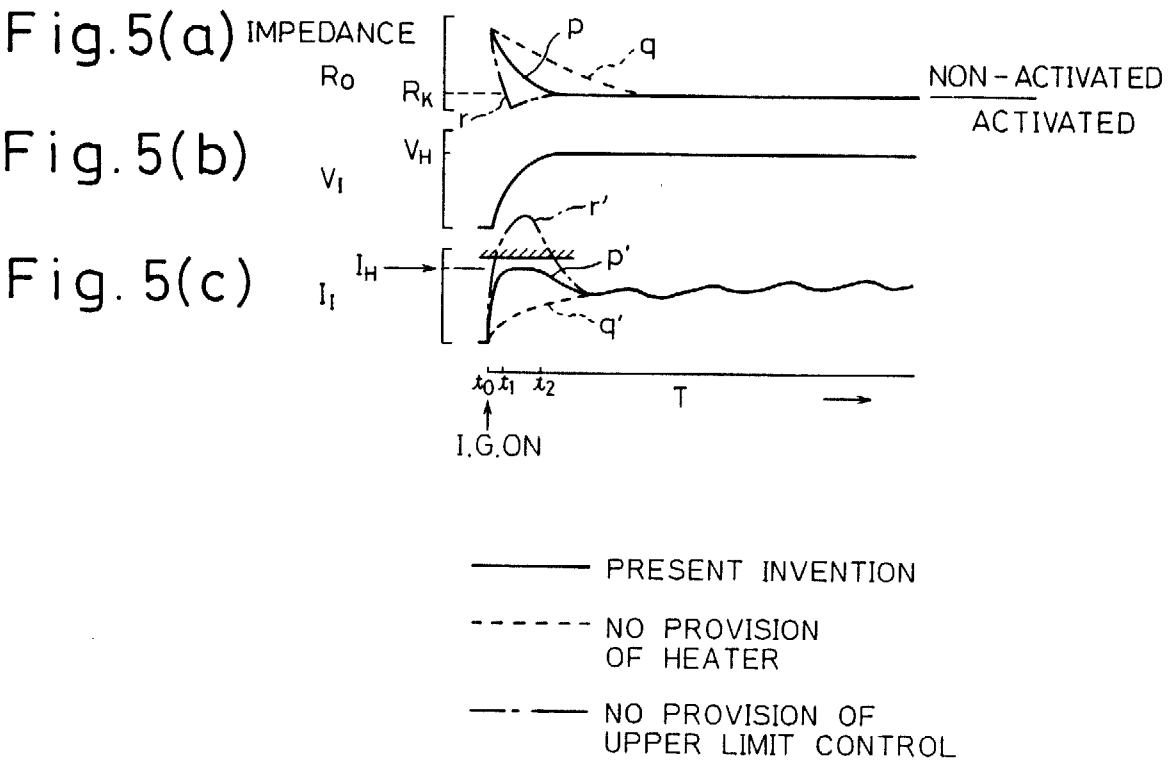
FIGS. 5(*a*) to 5(*c*) are timing charts showing the operation of the circuit for controlling the impedance of the oxygen sensor.

In FIGS. 5(*a*) to 5(*c*) at the time $t_0$, when the ignition key switch is made ON, the sensor 26 has an impedance $R_0$ which is higher than a predetermined value $R_K$ corresponding to an activated condition of the sensor 26, as shown by FIG. 6(*a*). At the time $t_1$, the electric current in the heater 40 attains the maximum value $I_H$, and at the time $t_2$, the maximum electric current value is maintained while the impedance of the sensor $R_K$ is decreased as shown by a line p, and the voltage level $V_I$ at the input 70-1 corresponding to the impedance is increased to the predetermined value $V_H$, whereby sensor is brought to an activated condition. After the activation condition is reached, the impedance is controlled to $R_K$, the voltage $V_I$ at the input 70-1 is controlled to the value of $V_H$, and the electric current in the heater 40 is controlled to a predetermined value by the operation of the comparator 70. During the normal operation of the first comparator 70, the level at the input 80-1 of the second comparator 80 is lower than the level at the input 80-2 of the second comparator 80, so that the output 80-3 of the comparator 80 issues a high level signal causing the diode 84 to be made ON, thus enabling the first comparator 70 to operate in accordance with the level at the input 70-1 thereof. It should be noted that the control of the impedance is delayed, as shown by the line q if the heater 40 is not provided, since the increase in the temperature is slowed as shown by the line q. Contrary to this, the electric current exceeds the maximum permissible level as shown by the line r if the means for limiting the maximum current is not provided.

Figure 7:
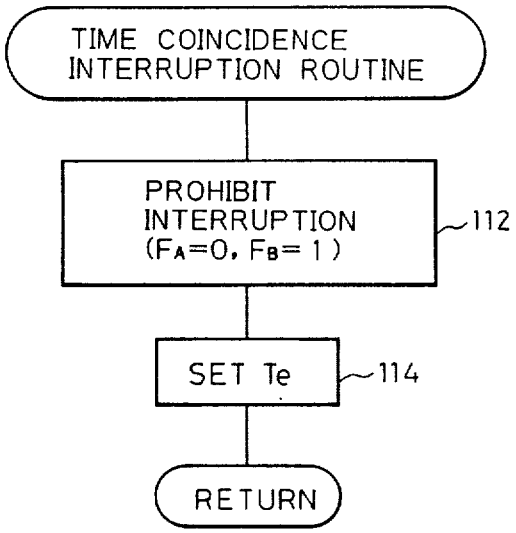
Figure 9:
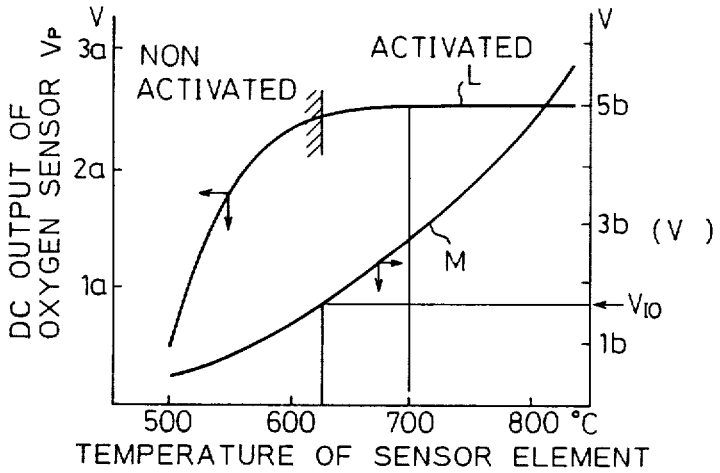
FIG. 9 shows characteristics of the output level of the oxygen sensor and the impedance of the sensor element with respect to the temperature of the sensor element.

Now the operation of the control circuit 20 in relation to the fuel injection control will be described with reference to the flow chart of FIGS. 6 and 7. The routine in FIG. 6 is commenced by detecting a predetermined crank angle position of the crankshaft before the timing for starting the fuel injection of a designated cylinder. If the fuel injection is designated for the intake stroke of the cylinder, the timing is at a crank angle position of 60 degrees before top dead center for the intake stroke. At step 100, it is determined if the value of the impedance $V_I$ of the sensor 26 is equal to or larger than the predetermined value $V_{IO}$ corresponding to the temperature of the sensor 26 when fully activated. In FIG. 9 a curve L represents a relationship between the temperature of the sensor 26 and the obtained sensor output $V_P$ and a curve M shows a relationship between the temperature of the sensor 26 and the impedance $V_I$ of the sensor 26 corresponding to the temperature of the sensor element 26, which has reached a predetermined value such as 630 degrees centigrade. The value of the impedance $V_{IO}$ at this predetermined temperature of the sensor 26 of 630 degrees centigrade is the threshold value for discriminating whether or not the sensor has reached an activation state. When it is determined that the actual value of impedance $V_I$ of the sensor 26 has not reached the predetermined value $V_{IO}$, i.e., the sensor 26 is not activated, the routine goes to step 101 where a basic fuel injection amount $T_{PO}$ is calculated from a first map, for calculating the basic fuel injection amount for a non-activated condition of the oxygen sensor 26. This first map is provided with values of the basic fuel injection amount with respect to combinations of the values of the engine speed and parameter related engine load, such as pressure in the intake manifold, amount of air flow per an engine revolution. When the oxygen sensor 26 is not activated, it is impossible to obtain a correct value of the basic fuel injection amount if it is calculated based on the oxygen partial pressure, and thus a factor such as vehicle speed or the throttle opening is used in place of the oxygen partial pressure for a calculation of the basic fuel injection. Although this factor is unsatisfactory from the view point of obtaining a correct value of the newly introduced air, it is satisfactory from the point of view of obtaining a roughly correct value of the newly introduced air, to ensure a necessary driveability of the engine during the non-activated state of the sensor 26. As well known to those skilled in this art, a map interpolation is carried out to obtain a value of the basic fuel injection amount corresponding to a combination of values of vehicle speed detected by the sensor 22 and engine speed detected by the sensor 25. At step 102, the map calculated value of the basic fuel injection value $T_{PO}$ is moved to a memory area Tp for storing the basic fuel injection amount.

Figure 10:
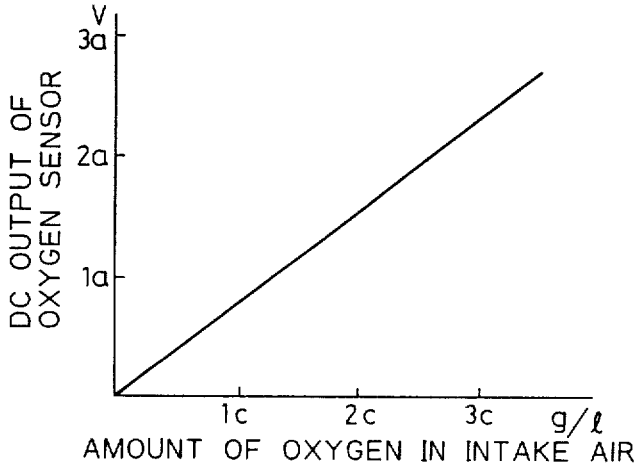
FIG. 10 shows the relationships between the amount of oxygen in the intake air and the oxygen sensor DC output level.

When it is determined that the oxygen sensor is activated at step 100, i.e., $V_I>V_{IO}$, the routine flows to step 103, where the basic fuel injection amount Tp is calculated from a main map of values of the basic fuel injection amount with respect to combinations of values of the engine speed NE and values of the output $PO_2$ of the oxygen sensor 26, which corresponds to a voltage Vp obtained at output of the low-pass filter 60 in FIG. 4 and indicates the oxygen partial pressure in the gas introduced into the engine combustion chamber, i.e., the amount of air newly introduced into the engine combustion chamber. FIG. 10 shows a relationship between the sensor output from the oxygen sensor 26 and the amount of oxygen in the gas introduced into the engine. It should be noted that the basic fuel injection amount Tp denotes the period for which the fuel injector 16 is open and the injector 16 injects an amount of fuel which enables the air-fuel ratio to be controlled to a theoretical air-fuel ratio of about 14.0, at a particular combination of the values of the engine speed NE and the oxygen partial pressure $PO_2$. It should be noted that the incorporation of the engine speed for calculation of the basic fuel injection value is used for a compensation of the intake efficiency, which is changed in accordance with the engine speed. It should be also noted that, in a conventional D-J system provided with an intake pressure sensor in place of the oxygen sensor 26 according to the present invention, the amount of the newly introduced air is indirectly calculated from the intake pressure. Contrary to this, according to the present invention, the basic fuel injection amount is calculated based on the combination of the output value $PO_2$ of the oxygen sensor 26 and the engine speed, as already explained. The micro-computer 20 obtains a map interpolation based on the actual combination of engine speed NE and $PO_2$ for calculating the basic fuel injection amount Tp.

Figures 8A, 8B, 8C:
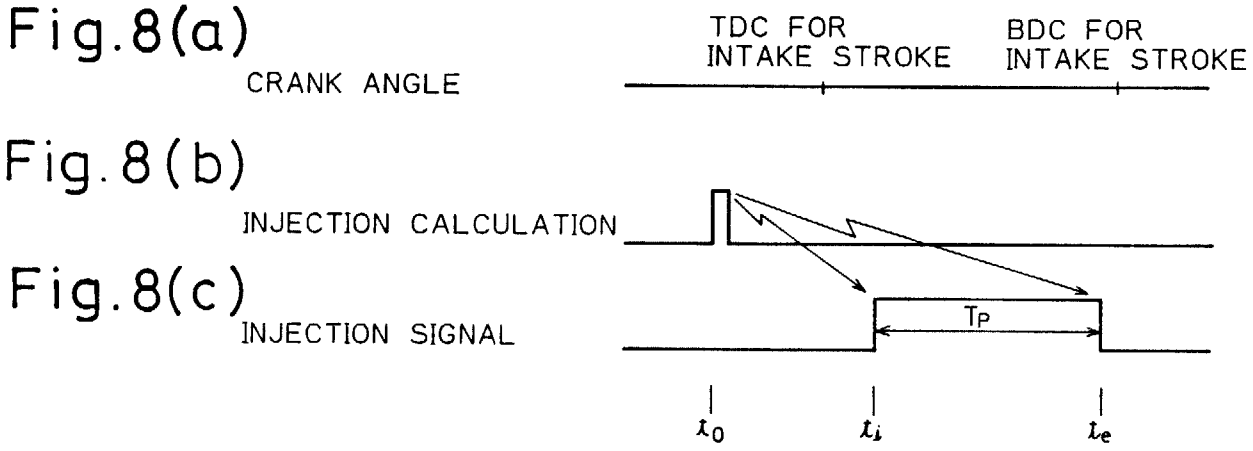
FIGS. 8(*a*) to 8(*c*) are timing charts showing the operation of the fuel injection by the control circuit in FIG. 1.

At step 104, the calculation of the timing $t_i$ for commencing a fuel injection can be made, and this timing can be suitably determined in accordance with the requirements of the engine. For example, the timing is determined so that a fuel injection of the calculated amount of fuel is completed by the end of the intake stroke. The microcomputer 20 calculates the time $t_i$ for commencing the fuel injection as a time after the present time $t_o$, (see FIG. 8). At step 106, the time $t_e$ at which the fuel injection is completed is calculated as the time $t_i$ plus the basic fuel injection amount $T_p$ calculated at step 102 or 103. At step 108, the flag $F_A$ is set and the flag $F_B$ is reset, to permit the interruption, and at step 110, the value of $t_i$ for commencing the fuel injection is moved to the first input of the compare register 23-2.

When the value of the free run counter 23-1 is identical to the value $t_i$ set to the compare register 23-2, i.e., the fuel injection timing is reached, the comparator outputs a high level signal causing the first gate 23-1 to be switched to the high level state, since the flag $F_A$ is also high level. Therefore, the flip-flop 23-5 is set to commence the fuel injection, and at the same time, a time coincidence interruption signal is issued to the microcomputer 20 so that the routine in FIG. 7 is commenced. At step 112, the flag $F_A$ is reset and the flag $F_B$ is set, to prohibit the interruption, and at step 114, the value of $t_e$ for stopping the fuel injection is obtained. Therefore, when the value of the free run counter 23-1 is identical to the value $t_e$ set to the compare register 23-2, i.e., the timing for stopping the fuel injection timing is reached, the comparator outputs a high level signal causing the second gate 23-2 to be switched to the high level state, since the flag $F_B$ is also high level. Accordingly, the flip-flop 23-5 is reset to stop the fuel injection. In this situation, the time coincidence interruption routine is prohibited since the first gate 23-1 is made OFF because the flag $F_A$ is now at a low level state.

The above embodiment is directed to a control of a fuel injection amount as a parameter determined by the amount of air newly introduced into the engine, but the present invention can be applied to a control of other parameters controlled by the newly introduced air, such as the ignition timing.

Although the present invention is described with reference to the above embodiment, many modifications and changes can be made by those skilled in this art without departing from the scope of the invention.

We claim:

1. An internal combustion engine comprising:

an engine body;

an intake system for introducing air into the engine body, said intake system having a throttle valve for controlling the amount of air introduced into the engine body;

control means for controlling an operating characteristic related to the amount of air introduced into the engine;

an exhaust system for removing resultant exhaust gases from the engine body;

oxygen sensor means, arranged in the intake system and responsive to a partial pressure of oxygen in the intake system, for detecting an amount of air newly introduced into the engine;

heater means arranged in the oxygen sensor for activating the oxygen sensor;

heater control means for controlling the temperature of the oxygen sensor to a predetermined value;

determining means for determining whether the sensor has been activated;

first calculating means, responsive to the detected oxygen partial pressure by the oxygen sensor means, for calculating a value of said engine operating characteristic matching the detected amount of air newly introduced into the engine when it is determined by the determining means that the sensor has been activated;

second detecting means for detecting, without using the detected oxygen partial pressure, a parameter indicating an amount of air newly introduced into the engine, and;

second calculating means, responsive to the detected parameter, for calculating a value of said engine operating characteristic matching the detected amount of air newly introduced into the engine when it is determined by the determining means that the sensor has not been activated.

2. An internal combustion engine according to claim 1, wherein said second detecting means comprises a sensor for detecting a degree of opening of the throttle valve.

3. An internal combustion engine according to claim 1, wherein said determining means comprises means for detecting a parameter related to a temperature of the oxygen sensor, and means for comparing the detected temperature parameter of the sensor with a predetermined value of the parameter for determining whether the oxygen sensor has been activated.

4. An internal combustion engine according to claim 3, wherein said parameter detecting means detects the impedance of the oxygen sensor means as the parameter related to the temperature of the sensor.

5. An internal combustion engine:

an engine body;

an intake system for introducing air into the engine body, said intake system having a throttle valve for controlling the amount of air introduced into the engine body;

control means for controlling an operating characteristic related to the amount of air introduced into the engine;

an exhaust system for removing resultant exhaust gases from the engine body;

oxygen sensor means, arranged in the intake system and responsive to a partial pressure of oxygen in the intake system, for detecting an amount of air newly introduced into the engine, said sensor means comprising a body formed of a solid electrolyte, a pair of electrodes formed on the electrolyte body, a diffusion means for generating a diffusion of oxygen at a controlled rate between the gas in the intake system and a reference gas, and means for controlling a predetermined voltage applied across the electrodes;

heater means arranged in the oxygen sensor for activating the oxygen sensor;

heater control means for controlling the temperature of the solid electrolyte body of the oxygen sensor so that the impedance of the sensor is controlled to a predetermined value;

said heater control means comprising means for applying an AC current across the electrodes to obtain an electric signal indicating an impedance of the sensor, comparing means for comparing the detected electric signal from the sensor with a predetermined level, and means for controlling the electric current in said heater means in accordance with the result of the comparison;

determining means, responsive to the impedance of the oxygen sensor, for determining whether the oxygen sensor has been activated;

calculating means, responsive to the detected oxygen partial pressure by the oxygen sensor means, for calculating a value of said engine operating characteristic matching the detected amount of air newly introduced into the engine when it is determined by the determining means that the sensor has been activated;

second detecting means for detecting, without using the detected oxygen partial pressure, a parameter indicating an amount of air newly introduced into the engine when it is determined by the determining means that the sensor has not been activated and;

second calculating means, responsive to the detected parameter, for calculating a value of said engine operating characteristic matching the detected amount of air newly introduced into the engine.

6. An internal combustion engine according to claim 5, further comprising electric current control means for cancelling the operation of the comparing means so that an excessive increase of the electric current in the heater means is prevented.

7. An internal combustion engine according to claim 6, wherein said electric current control means comprises a comparator means which compares the electric current in the heater means with a predetermined upper limit, and means for cancelling the operation of the first comparator means when the electric current in the heater means becomes larger than the predetermined value.

8. An internal combustion engine according to claim 7, wherein said cancelling means comprises a diode arranged between the first and second comparator means in such a manner that the operation of the first comparator means is cancelled when the electric current in the heater becomes higher than the predetermined value, whereby the heater is deenergized.

9. An internal combustion engine according to claim 5, wherein said second detecting means detects the degree of opening of the throttle valve.

* * * * *